US006689314B2

(12) United States Patent
Bushman et al.

(10) Patent No.: US 6,689,314 B2
(45) Date of Patent: Feb. 10, 2004

(54) PROCESS FOR ACTIVATING OXYGEN SCAVENGER COMPONENTS DURING A GABLE-TOP CARTON FILLING PROCESS

(75) Inventors: Alexander Craig Bushman, Loveland, OH (US); Gregory J. Castle, Wilder, KY (US); Richard D. Pastor, Cincinnati, OH (US); Tricia S. Reighard, Loveland, OH (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/919,952

(22) Filed: Aug. 2, 2001

(65) Prior Publication Data

US 2002/0025273 A1 Feb. 28, 2002

Related U.S. Application Data

(60) Provisional application No. 60/223,736, filed on Aug. 8, 2000.

(51) Int. Cl.[7] ..... A23L 1/015; B65B 31/02

(52) U.S. Cl. ..... 422/24; 53/425; 53/428

(58) Field of Search ..... 422/24, 28; 53/425, 53/428

(56) References Cited

U.S. PATENT DOCUMENTS

| | | | | |
|---|---|---|---|---|
| 4,375,145 A | * | 3/1983 | Mosse et al. | 53/425 |
| 5,202,052 A | | 4/1993 | Zenner et al. | |
| 5,211,875 A | | 5/1993 | Speer et al. | |
| 5,310,497 A | | 5/1994 | Ve Speer et al. | |
| 5,350,622 A | | 9/1994 | Speer et al. | |
| 5,399,289 A | | 3/1995 | Speer et al. | |
| 5,425,896 A | | 6/1995 | Speer et al. | |
| 5,498,364 A | | 3/1996 | Speer et al. | |
| 5,529,833 A | | 6/1996 | Speer et al. | |
| 5,605,996 A | | 2/1997 | Chuu et al. | |
| 5,648,020 A | | 7/1997 | Speer et al. | |
| 5,660,761 A | | 8/1997 | Katsumoto et al. | |
| 5,700,554 A | | 12/1997 | Speer et al. | |
| 5,744,246 A | | 4/1998 | Ching | |
| 5,759,653 A | | 6/1998 | Collette et al. | |
| 5,776,361 A | | 7/1998 | Katsumoto et al. | |
| 5,798,055 A | | 8/1998 | Blinka et al. | |
| 5,804,016 A | | 9/1998 | Schmidt et al. | |
| 5,811,027 A | | 9/1998 | Speer et al. | |
| 5,866,649 A | | 2/1999 | Hong et al. | |
| 5,911,910 A | * | 6/1999 | Becraft et al. | 252/188.28 |
| 5,941,037 A | | 8/1999 | Hallock et al. | |
| 5,952,066 A | | 9/1999 | Schmidt et al. | |
| 5,977,212 A | | 11/1999 | Ebner et al. | |
| 5,981,676 A | | 11/1999 | Gauthier et al. | |
| 5,985,169 A | | 11/1999 | Miller et al. | |
| 5,993,688 A | | 11/1999 | Blinka et al. | |
| 6,039,922 A | | 3/2000 | Swank et al. | |
| 6,056,918 A | | 5/2000 | Palaniappan et al. | |
| 6,057,013 A | | 5/2000 | Ching et al. | |
| 6,058,678 A | | 5/2000 | Lees | |
| 6,233,907 B1 | | 5/2001 | Cook, Jr. et al. | |

FOREIGN PATENT DOCUMENTS

| | | | |
|---|---|---|---|
| WO | WO 98/05571 | * | 2/1998 |
| WO | WO 02/36437 | * | 5/2002 |

* cited by examiner

*Primary Examiner*—Matthew A. Thexton
(74) *Attorney, Agent, or Firm*—Melvin Fletcher; Christopher J. McDonald

(57) ABSTRACT

A method for inducing oxygen scavenging within paperboard package structures using ultraviolet light to activate the scavenging material during the filling process or prior to the filling process for gable-type paperboard packages. An ultraviolet light source is placed in close proximity to a gable-top blank or along the horizontal chain or line following bottom formation and prior to filling a carton with product.

12 Claims, 7 Drawing Sheets

| |
|---|
| 60 |
| 65 |
| 70 |
| 75 |
| 80 |
| 85 |
| 90 |

FIG. 5

| |
|---|
| 120 |
| 125 |
| 130 |
| 135 |
| 140 |
| 145 |
| 150 |
| 155 |
| 160 |

FIG. 6

| |
|---|
| 210 |
| 215 |
| 220 |
| 225 |
| 230 |
| 235 |

FIG. 7

| |
|---|
| 240 |
| 245 |
| 250 |
| 255 |
| 260 |
| 265 |

FIG. 8

| |
|---|
| 280 |
| 285 |
| 290 |
| 295 |
| 300 |
| 305 |
| 310 |
| 315 |

FIG. 9

| |
|---|
| 330 |
| 335 |
| 340 |
| 345 |
| 350 |
| 355 |
| 360 |
| 365 |

FIG. 10

PROCESS FOR ACTIVATING OXYGEN SCAVENGER COMPONENTS DURING A GABLE-TOP CARTON FILLING PROCESS

The instant application claims the priority of U.S. provisional patent application Ser. No. 60/223,736, filed Aug. 8, 2000.

BACKGROUND OF THE INVENTION

The invention relates to a method for inducing oxygen scavenging within paperboard packaging structures using ultraviolet light to activate the scavenging material. An ultraviolet lamp is placed in close proximity to a blank along the horizontal chain or line following carton bottom formation and prior to filling a carton or blank with product. An alternative form of this invention is to activate the package using a separate apparatus prior to placement on the filling machine.

In the past, oxygen scavenging polymer materials have been controlled by ultraviolet light, which is used to initiate the scavenging reaction. These materials have been placed by extrusion or otherwise, into multilayer structures.

U.S. Pat. No. 5,529,833, Speer et al, discloses a multilayer structure having an oxygen scavenger material incorporated therein. The material may be a distinct layer or may be combined with a heat-seal layer, a barrier layer or a tie layer in the laminate. Nowhere is there a discussion or suggestion of activating the oxygen scavenging material by ultraviolet radiation in the filling machine chain or line following carton bottom formation and prior to filling a produced package or carton.

U.S. Pat. No. 6,039,922, Swank et al, discloses a method for sterilizing a carton using UV light in combination with hydrogen peroxide. Nowhere is there a discussion or suggestion of activating an oxygen scavenging material.

It is an object of the present invention to provide a method of optimally activating oxygen scavenger materials with UV light in and during carton formation.

It is a further objective of the present invention to provide a method of activating oxygen scavenger materials by exposure to ultraviolet lamps prior to, or during the chain or filling line for cartons.

It is a further objective of the present invention to provide a method of activating oxygen scavenger materials in a filling machine after carton bottom formation and before filling a carton with product.

It is a further objective of the present invention to provide a method of activating oxygen scavenger materials in a preliminary step prior to carton formation and filling on a filling machine.

SUMMARY OF THE INVENTION

The shortcomings of the existing carton structures which contain only passive oxygen barriers are overcome by the following optimal methods of activating an oxygen scavenger material contained within a packaging structure. The packaging structure containing the scavenging material is produced into a blank for carton formation. In a first embodiment, after the bottom seal is produced in a gable-top type carton, the carton is exposed to ultraviolet radiation in the filling machine chain or line following carton bottom formation. In a second embodiment, the carton blank is opened into a tube and is exposed to ultraviolet radiation and activated using a separate apparatus prior to placement on the gable-top filling machine.

BRIEF DESCRIPTION OF THE DRAWINGS

FIG. 5 is a cross-sectional presentation of a laminate containing oxygen scavenging polymers activated by the inventive apparatus;

FIG. 6 is a cross-sectional presentation of a laminate containing oxygen scavenging polymers activated by the inventive apparatus;

FIG. 7 is a cross-sectional presentation of a laminate containing oxygen scavenging polymers activated by the inventive apparatus;

FIG. 8 is a cross-sectional presentation of a laminate containing oxygen scavenging polymers activated by the inventive apparatus;

FIG. 9 is a cross-sectional presentation of a laminate containing oxygen scavenging polymers activated by the inventive apparatus;

FIG. 10 is a cross-sectional presentation of a laminate containing oxygen scavenging polymers activated by the inventive apparatus;

DETAILED DESCRIPTION OF THE INVENTION

The invention focuses on gable-top filling machines, and the like, and the use of ultraviolet lamps within the chain or line of a filling machine. The ultraviolet lamps generate ultraviolet light to activate photosensitive oxygen scavenging polymer materials. The lamps contain wavelengths of light ranging from 200–700 nm, preferably from 200–400 nm and include ultraviolet B light in a wavelength ranging from 280–320 nm and ultraviolet C light in a wavelength ranging from 250–280 nm.

Activation of the carton samples was achieved with dosage of the ultraviolet light ranging from 150 mJ/cm$^2$ to 8000 mJ/cm$^2$, with intensity ranges from 100 mW/cm$^2$ to 8000 mW/cm$^2$.

The range of activation times varies based on the intensity of the lamps and filling operation speeds. The range can run from approximately 1 second to 10 seconds, with the optimal activation time being 2.5 seconds, and with a typical machine speed of 60 cartons/minute/line and an exposure over two stations.

Figure 1:
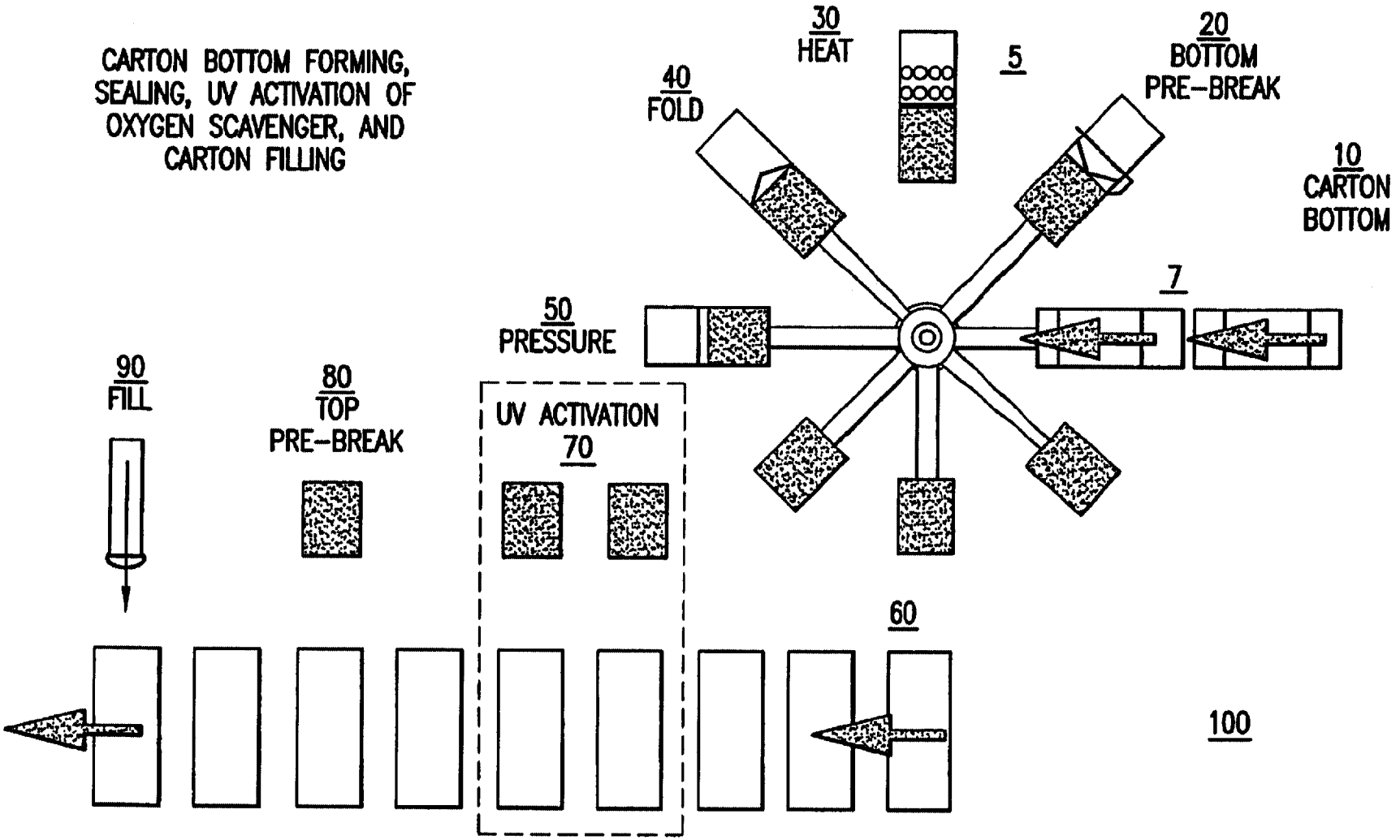
FIG. 1 is a flow diagram of a step-by-step process of carton formation and filling.

FIG. 1 depicts a filling apparatus line 100 including a carton bottom forming procedure 5, where a blank 7, having a carton bottom 10 is placed on a wheel. Station 20 is where bottom pre-break occurs, followed by heat 30, folding 40 and pressure 50, thereby completing the formation of a carton bottom. The carton is placed on a line at station 60 and then travels to the ultraviolet activation area 70. Depicted is a simultaneous treatment of two cartons. This treatment procedure can be modified for one or more. The activated container has top pre-break 80 of the container followed by filling of product 90.

Many other steps or stations can be added to the formation process. These include, but are not limited to, spout application or hydrogen peroxide sterilization. The synergistic effect of hydrogen peroxide and ultraviolet light has been shown to lead to increased activation rate and reduced latency period (time between activation and significant scavenging).

Figure 2:
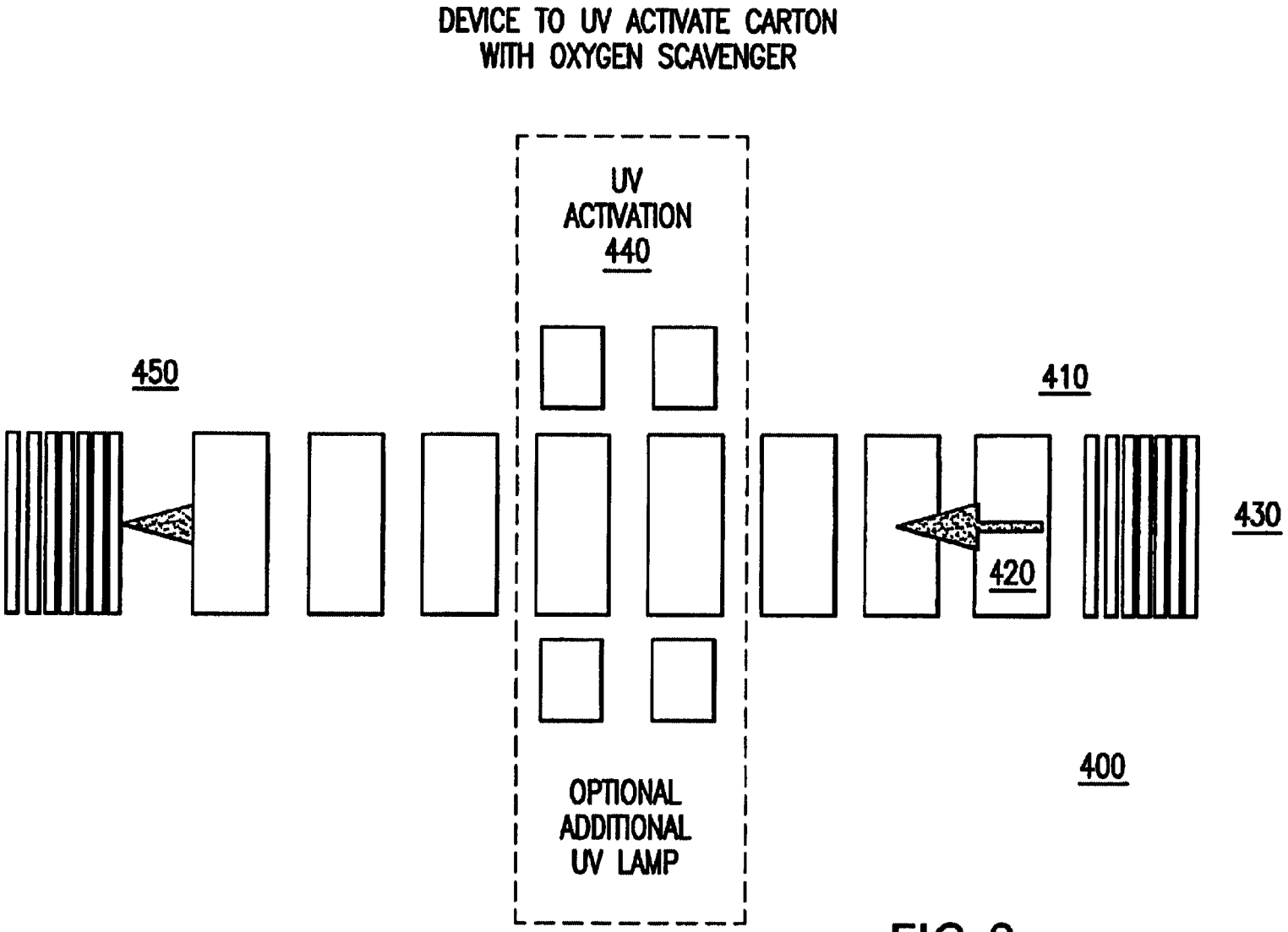
FIG. 2 is a flow diagram of a step-by-step process of carton activation prior to formation and filling on a filling machine.

FIG. 2 depicts a carton activation apparatus 400 including a carton opening procedure 410, where a blank 420, is placed on a line at station 430 and then travels to the ultraviolet activation area 440. Depicted is the treatment of a carton from both ends using two lamps. This treatment procedure can be modified to include activation from a single end of the carton. The activated container is discharged at station 450 and stacked.

Figure 3:
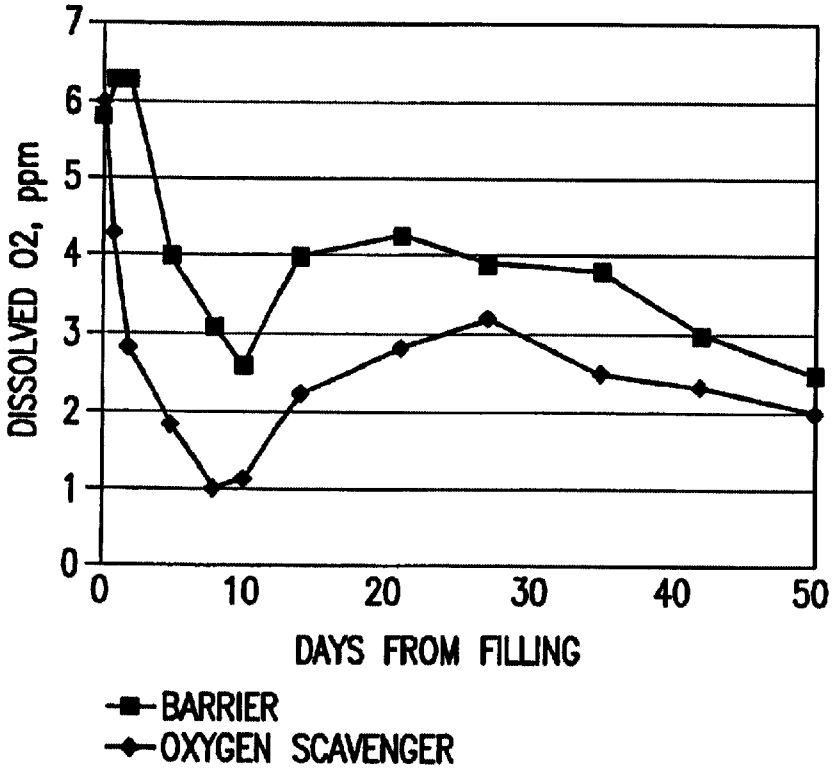
FIG. 3 is a graphic representation of dissolved oxygen against days from filling comparing a oxygen scavenger polymer container and a container without activation in the methodology of the invention.
Figure 4:
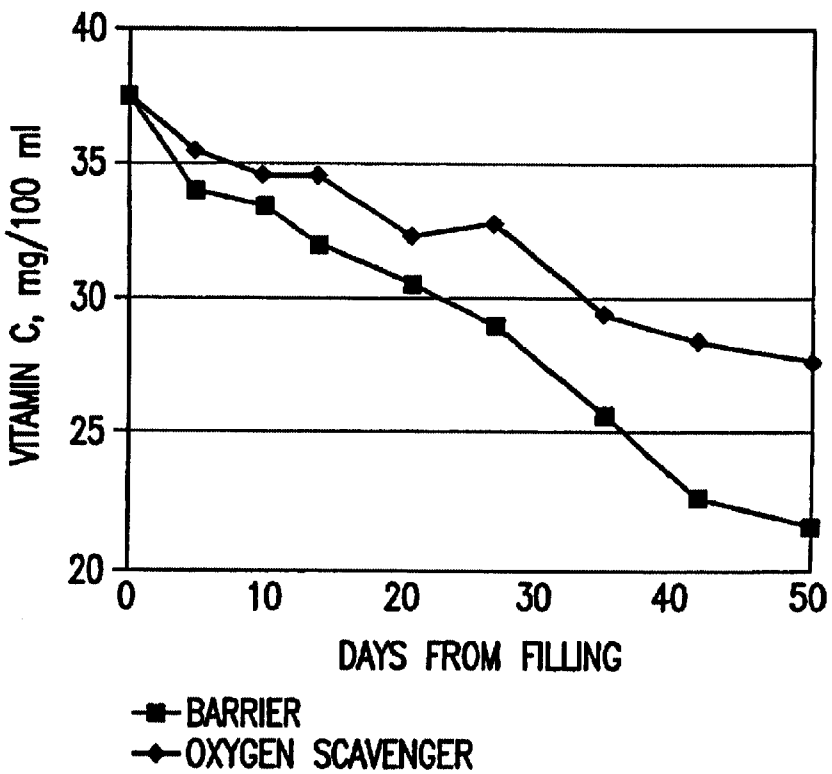
FIG. 4 is a graphic representation of Vitamin C retention against days from filling comparing a oxygen scavenger polymer container and a container without activation in the methodology of the invention.

The performance of the oxygen scavenger carton activated by the desired methodology, versus a control barrier carton, is evidenced by the graphical results depicted in FIGS. 3 and 4.

The results clearly show that there is improved Vitamin C retention and reduced dissolved oxygen due to consumption by the oxygen scavenger, within the carton, compared to a control barrier.

In addition, independent trained taste panel evaluations have demonstrated that orange juice packaged in oxygen scavenging cartons is both distinctly different than the control (99% confidence level; 18 of 26 panelists correctly identified the odd sample in triangle testing) and preferred (oxygen scavenger sample described as "sweeter" and "more natural") compared to the control.

Various oxygen scavenging materials can be used within the contemplation of the invention including, but not limited to, polybutadiene systems (1,2 polybutadiene), anthroquinone systems and specific three phase blends of materials: composed of a polymer containing a reactive double bond; a photoinitiator; and a transition metal catalyst (cobalt salt). The polymer of the three phase blend can be a poly(ethylene/methyl acrylate/cyclohexene-methyl acrylate) (EMCM).

Alternatively, the invention focuses on the production of an activated packaging blank which is subsequently placed onto a gable top filling machine. The activated packaging blank, namely which is activated for oxygen scavenging is produced by first having the blank conventionally produced from a paperboard laminate, subsequently opening the blank into a tube form and then exposing the tube form to ultraviolet radiation to form a blank which has been activated for oxygen scavenging.

Various laminate structures can be produced, such as depicted in FIGS. 5–10.

A first proposed structure has a gloss layer 60 of low density polyethylene (preferably 12 lbs.); a paperboard substrate basestock layer 65 (preferably 166–287 lbs.); an abuse resistant and oxygen barrier layer 70 (preferably a polyamide such as nylon of approximately 5 lbs.); a tie layer 75 (preferably 1.5 lbs.); a caulking material layer 80 (preferably 12 lbs. low density polyethylene); the oxygen scavenger layer 85 (containing preferably 5 lbs. of scavenging resin); and a product contact layer 90 of low density polyethylene (approximately 4 lbs.). All weights are given in lbs. per 3,000 square feet.

The oxygen scavenger layer can be a pure oxygen scavenging material or can be blended with low density polyethylene, high density polyethylene, linear low density polyethylene, metallocene, polypropylene, or blends thereof. An odor/flavor absorbing compound may be included in the blend as well.

The structure provides an abuse resistant layer to improve filling machine performance, it provides an oxygen barrier to prevent oxygen ingress into the package and to ensure that oxygen is preferentially scavenged from the interior of the package, an oxygen scavenging material and a heat seal layer.

FIG. 6 illustrates an alternate structure: including a gloss layer 120; a paperboard substrate basestock 125; an abuse-resistant and oxygen barrier layer 130; a tie layer 135; the oxygen scavenger blended with a caulking material 140; a tie material 145; a flavor barrier such as glycol modified polyethylene terephthalate, ethylene vinylalcohol copolymer, and nylon, alone, or blended with a low density polyethylene (approximately 5 lbs.) 150; a tie layer 155; and a product contact heat seal layer 160. This structure improves filling machine performance and provides for improved product flavor. Again, all weights are given in lbs. per 3,000 square feet.

FIG. 7 depicts a further embodiment of a scavenging laminate. The gloss layer 210 (12 lbs.) is low density polyethylene. The gloss layer is coated on the paperboard substrate basestock 215 (166–287 lbs.). Further, there is provided an abuse resistant and oxygen barrier layer 220 (such as 5 lbs. of nylon), followed by a tie layer 225 (1.5 lbs.). The tie layer 225 is followed by the oxygen scavenger layer 230 (5 lbs.), a combined flavor barrier and a product heat seal layer 235 (10 lbs.). Weights of the layers are again given in lbs. per 3,000 square feet.

This structure provides an abuse resistant layer to improve filling machine performance, an oxygen barrier to ensure that oxygen is preferentially scavenged from the interior of the package, the oxygen scavenging material, and a flavor barrier combined with a heat sealable material.

FIG. 8 depicts a structure that provides an abuse resistant layer and oxygen barrier (5 lbs.) 250 to ensure that oxygen is preferentially scavenged from the interior of the package, followed by a tie layer 255 (1.5 lbs.), the oxygen scavenging layer (containing 5 lbs. of oxygen scavenging resin) 260, and a heat sealable layer (4 lbs.) 265 which contains an odor/flavor absorbing compound. The gloss layer 240 (12 lbs.) is low density polyethylene. The gloss layer is coated on the paperboard substrate basestock 245 (166–287 lbs.). Weights are given in lbs. per 3,000 square feet.

FIG. 9 depicts a structure that provides a foil laminate 300 as an oxygen barrier, the oxygen scavenging layer (containing 5 lbs. of oxygen scavenging resin) 310, and a heat sealable layer (4 lbs.) 315. A tie layer, 305, is placed between the foil and the oxygen scavenging layer. The gloss layer 280 (12 lbs.) is low density polyethylene. The gloss layer is coated on the paperboard substrate basestock 285 (166–287 lbs.). Onto the basestock is coated a caulking layer of low density polyethylene, 295, followed by a tie layer, 300, to the foil laminate. (Weights are given in lbs. per 3,000 square feet.)

FIG. 10 depicts a structure that provides a foil laminate 350 as an oxygen barrier, the oxygen scavenging layer (containing 5 lbs. of oxygen scavenging resin) 360, and a heat sealable layer (4 lbs.) 365 which contains an odor/flavor absorbing compound. A tie layer, 355, is placed between the foil and the oxygen scavenging layer. The gloss layer 330 (12 lbs.) is low density polyethylene. The gloss layer is coated on the paperboard substrate basestock 335 (166–287 lbs.). Onto the basestock is coated a caulking layer of low density polyethylene, 340, followed by a tie layer, 345, to the foil laminate. (Weights are given in lbs. per 3,000 square feet.)

Figure 11:
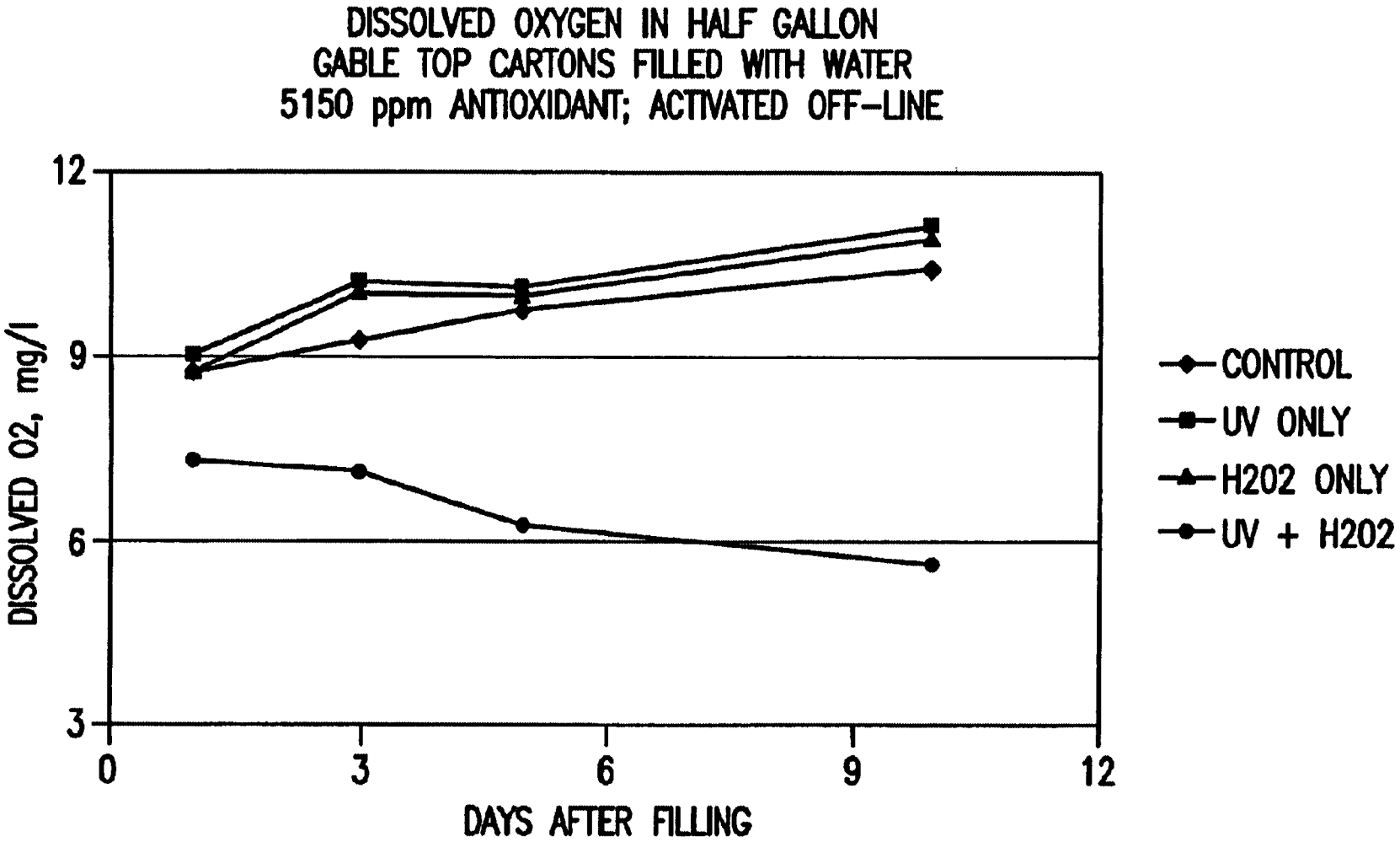
FIG. 11 is a graphical representation of dissolved oxygen in half gallon gable top cartons filled with water.
Figure 12:
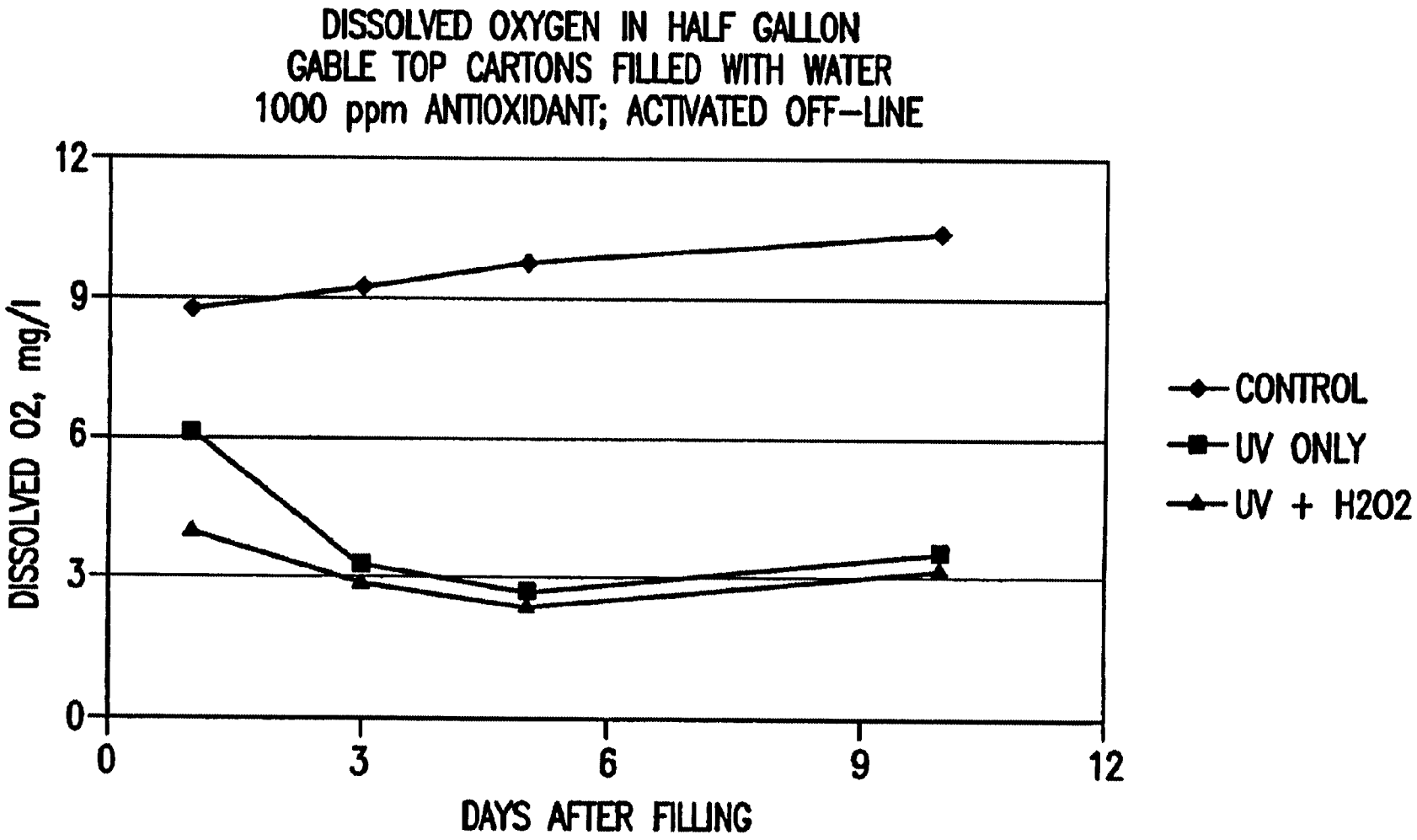
FIG. 12 is a graphical representation of dissolved oxygen in half gallon gable top cartons filled with water.
Figure 13:
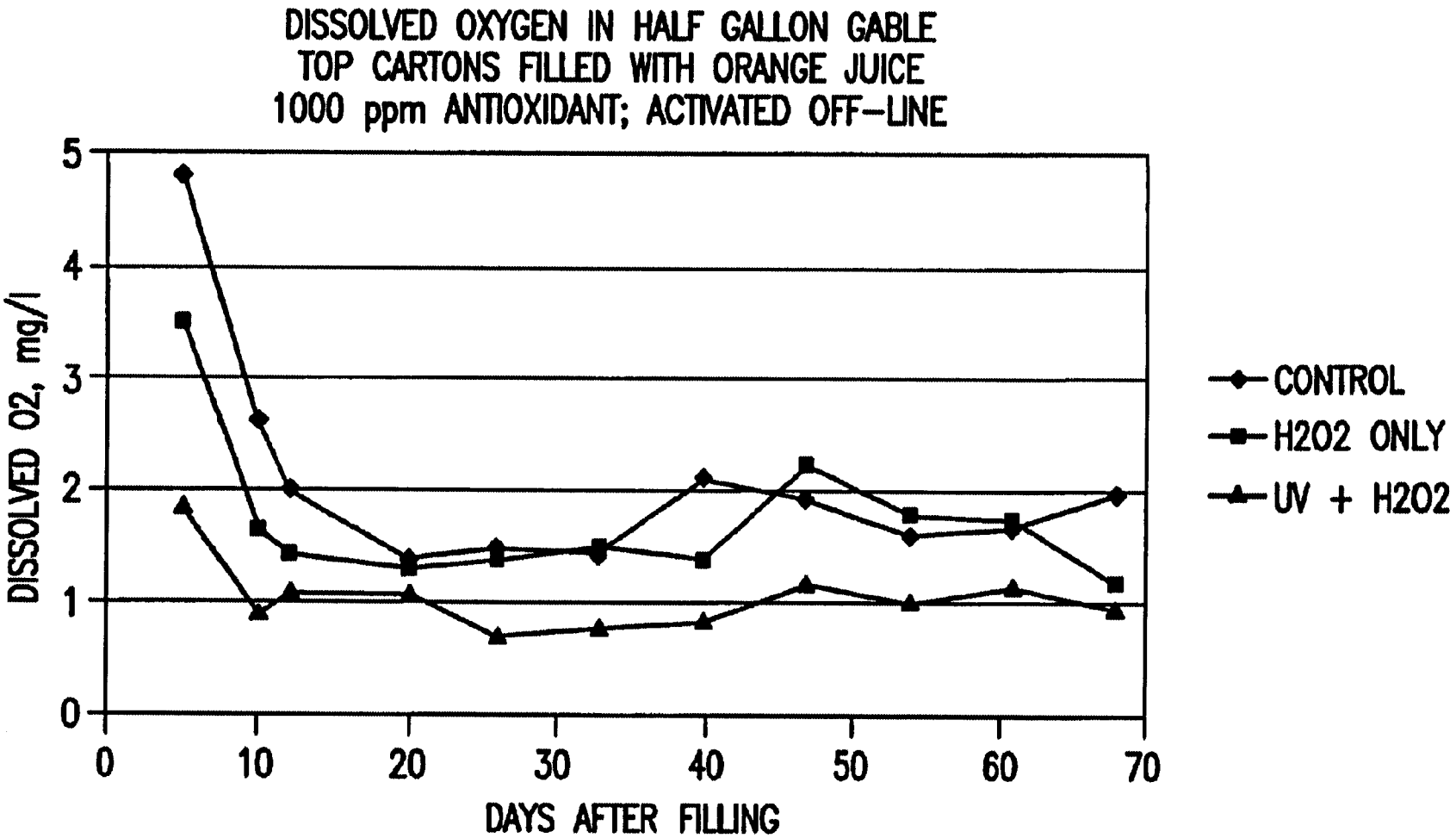
FIG. 13 is a graphical representation of dissolved oxygen in half gallon gable top cartons filled with orange juice.

FIGS. 11–13 are the results of tests displayed graphically of half gallon gable top containers which have oxygen dissolved in water (FIGS. 11 and 12) and orange juice (FIG. 13) in which the oxygen scavenger material has been activated off line.

FIG. 11 depicts 5150 parts per million of antioxidant in the blank and how much $O_2$ is dissolved in the water after 1–10 days.

FIG. 12 depicts 1000 parts per million of antioxidant in the blank and how much $O_2$ is dissolved in the water after 1–10 days.

FIG. 13 depicts 1000 parts per million of antioxidant in the blank and how much $O_2$ is dissolved in the orange juice after 1–70 days.

Each of the oxygen scavenging materials is activated in the filling machine at the ultraviolet treatment station or prior to the filling machine at the pretreatment station.

The present invention is not intended to be limited to the embodiments described above, but to encompass any and all embodiments within the scope of the claims.

What is claimed is:

1. A method of inducing oxygen scavenging within packaging structures comprising the steps of:

a) producing a packaging blank from a paperboard laminate containing an oxygen scavenging material therein;

b) placing the packaging blank on a filling machine;

c) forming a bottom seal in the packaging blank;

d) exposing the packaging blank to ultraviolet radiation for 1 to 10 seconds to form an activated packaging blank; and e) activating the oxygen scavenging material by applying hydrogen peroxide to the packaging blank.

2. The method of inducing oxygen scavenging within packaging structures as claimed in claim 1, further comprising the step of:

(f) filling the activated packaging blank.

3. The method of inducing oxygen scavenging within packaging structures as claimed in claim 1, wherein the ultraviolet radiation is supplied in a dosage ranging from 150 mJ/cm$^2$ to 8000 mJ/cm$^2$.

4. The method of inducing oxygen scavenging within packaging structures as claimed in claim 1, wherein the ultraviolet radiation is dispersed by at least one ultraviolet lamp having a wavelength of light ranging from 200–700 nm.

5. The method of inducing oxygen scavenging within packaging structures as claimed in claim 1, further comprising the step of spout application.

6. The method of inducing oxygen scavenging within packaging structures as claimed in claim 1, further comprising the step of hydrogen peroxide sterilization.

7. A method of inducing oxygen scavenging within packaging structures comprising the steps of:

a) producing a paperboard laminate packaging blank containing an oxygen scavenging material therein;

b) opening the paperboard laminate packaging blank into a tube form; and c) exposing the tube form to ultraviolet radiation to form an activated blank.

8. The method of inducing oxygen scavenging within packaging structures as claimed in claim 7, further comprising the step of:

d) loading the activated blank onto a filling machine.

9. The method of inducing oxygen scavenging within packaging structures as claimed in claim 7, wherein the ultraviolet radiation is supplied in a dosage ranging from 150 mJ/cm$^2$ to 8000 mJ/cm$^2$.

10. The method of inducing oxygen scavenging within packaging structures as claimed in claim 7, wherein the ultraviolet radiation is dispersed by at least one ultraviolet lamp having a wavelength of light ranging from 200–700 nm.

11. The method of inducing oxygen scavenging within packaging structures as claimed in claim 7, further comprising applying hydrogen peroxide to the packaging blank after the blank is exposed to the ultraviolet light.

12. A method of making an oxygen scavenging package, comprising forming a blank, incorporating oxygen scavenging material into said blank, the step of activating said oxygen scavenging material with two different activators, wherein two different activators comprise hydrogen peroxide and ultraviolet light.

* * * * *